US005266130A

United States Patent [19]

Uchida et al.

[11] Patent Number: 5,266,130

[45] Date of Patent: Nov. 30, 1993

[54] PROCESS FOR MANUFACTURING ALUMINUM ALLOY MATERIAL HAVING EXCELLENT SHAPE FIXABILITY AND BAKE HARDENABILITY

[75] Inventors: Hidetoshi Uchida; Hideo Yoshida, both of Tokyo, Japan

[73] Assignee: Sumitomo Light Metal Industries, Ltd., Tokyo, Japan

[21] Appl. No.: 930,726

[22] Filed: Aug. 14, 1992

[30] Foreign Application Priority Data

Jun. 30, 1992 [JP] Japan ..... 4-172780

[51] Int. Cl.[5] ..... C22F 1/04

[52] U.S. Cl. ..... 148/552; 148/551; 148/691; 148/694; 148/415; 148/417; 148/439; 148/440

[58] Field of Search ..... 148/552, 551, 691, 694, 148/415, 417, 439, 440; 420/546, 534, 535

[56] References Cited

FOREIGN PATENT DOCUMENTS 0097319 1/1984 European Pat. Off. ..... 148/439

0222479 5/1987 European Pat. Off. ..... 148/440

*Primary Examiner*—R. Dean

*Assistant Examiner*—Robert R. Koehler

*Attorney, Agent, or Firm*—Flynn, Thiel, Boutell & Tanis

[57] ABSTRACT

A process for manufacturing an aluminum alloy material having excellent shape fixability and bake hardenability, the process comprising: conducting semicontinuous casting of an aluminum alloy comprising 0.4 to 1.7% (wt.%) Si and 0.2 to 1.4% Mg, optionally further comprising 0.05% or less Ti and 100 pm or less B and optionally further comprising at least one member selected from the group of 1.00% or less Cu, 0.50% or less Mn, 0.20% or less Cr and 0.20% or less V, with the balance consisting of Al and unavoidable impurities, subjecting the cast alloy to conventional hot rolling; conducting solution heat treatment by holding the hot-rolled alloy at a temperature of from 450 to 580° C. for 10 minutes or less; conducting first-stage cooling of the alloy at a cooling rate of 200° C./min or more to a quenched temperature in the range of from 60 to 250° C.; and subjecting the alloy to second-stage cooling at a cooling rate selected within the zone ABCD shown in the attached FIG. 2.

3 Claims, 2 Drawing Sheets

PROCESS FOR MANUFACTURING ALUMINUM ALLOY MATERIAL HAVING EXCELLENT SHAPE FIXABILITY AND BAKE HARDENABILITY

BACKGROUND OF THE INVENTION

1. Field of the Invention

The present invention relates to a process for manufacturing an aluminum alloy material for forming which has excellent formability in press working, shape fixability and bake hardenability, and which is especially suitable for the manufacture of transport machinery, such as the body sheet material of automobiles.

2. Description of the Prior Art

Various types of aluminum alloys have heretofore been developed and used as the material of transport machinery, such as the body sheet material of automobiles. Especially, in recent years, a tendency toward using aluminum alloys instead of steel materials to obtain a light-weight structure with respect to various parts is very conspicuous in compliance with the tightening of legal regulations established as the countermeasures against earth warming.

For example, the body sheet materials of automobiles should satisfy the requirements for (1) formability, (2) shape fixability (accurate reproduction of the shape of press dies in press working), (3) high strength, (4) dentability, and (5) corrosion resistance, etc.

Under these circumstances, in Japan where the requirements from the press work industry are strict, the development of the body sheet materials of automobiles or the like has mainly been directed to 5000 series Al-Mg-Zn-Cu alloys (see Japanese Patent Application Laid-Open Nos. 53-103914 and 58-171547) and Al-Mg-Cu alloys (see Japanese Patent Application Laid-Open No. 1-219139) having excellent formability, and these body sheet materials have been mass-produced and put to practical use.

By contrast, in the United Stated and Europe, ( 6009, 6111 and 6016 alloys have been developed as the 6000 series Al-Mg-Si alloys having high strength. These alloys acquire high strength by heat treatment at 200° C. for about 30 minutes in the baking step (bake hardening). The increase in the strength enables a marked decrease in thickness from 5000 series alloys, i.e., a light-weight structure, to be attained. However, in Japan, since the bake temperature is as low as about 170 to 180° C., it is unexpectable to achieve a satisfactory high strength by 30-minute heating with the current 6000 series alloys or the current manufacturing process. Moreover, the current 6000 series alloys suffer from room temperature age hardening, though slightly, and have problems that the formability is poor and the corrosion resistance is also relatively poor. Therefore, in Japan where the requirements for various performances are strict, the 6000 series alloys have no significant advantage over the 5000 series alloys so far as the baking step is conducted at a higher temperature or for a longer period of time as compared with the prior art, so that the former has been hardly employed.

On the other hand, the shape fixability can be improved as the Young's modulus is increased and the yield strength is decreased (see SAE Paper No. 890719). Because the Young's modulus of an aluminum alloy is 70000 MPa which is about one third of 210000 MPa for steel, it is impossible to obtain a material having the same shape fixability as that of a steel sheet, unless the yield strength of the aluminum alloy sheet in press working is considerably decreased. However, when it is intended to obtain a structure having a tensile strength of about 300 MPa comparable to that of a steel sheet, the yield strength of the aluminum alloy sheet manufactured by the conventional method is inevitably increased to about 140 MPa or above in both of the 5000 series alloy and the 6000 series alloy, which is likely to give rise to a poor shape fixability.

Thus, excellent formability, shape fixability, high strength, dentability and corrosion resistance are required of the sheet material used as body panels of automobiles. However, the shape fixability, high strength and dentability are properties contrary to each other. Accordingly, the development of the sheet material which can meet all the requirements has been desired in the art.

On the other hand, a proposal has been made on a molding Al alloy sheet having excellent weldability, filiform corrosion resistance, formability and bake hardenability manufactured by subjecting and Al-1%Mg-1%Si-based aluminum alloy sheet material to solution heat treatment through rapid heating and rapidly cooling the treated material to regulate the grain size and the electrical conductivity to respective particular values (see Japanese Patent Application Laid-Open No. 64-65243). Further, the present inventors have proposed a process for manufacturing an aluminum alloy for forming having excellent shape fixability and bake hardenability, which comprises subjecting an Al-Si-Mg-based aluminum alloy sheet material to solution heat treatment through rapid heating, rapidly cooling the treated material, allowing the cooled material to stand at room temperature for a period of time as short as possible and heating and holding the material at a temperature of from 50 to 150° C. (see Japanese Patent Application Laid-Open No. 2-269508).

As described above, in 5000 series aluminum alloys, although the formability is excellent, when a tensile strength of 300 MPa or more comparable to that of a steel sheet is intended, the yield strength becomes 140 MPa or more, so that no shape fixability can be attained in press working. On the other hand, in 6000 series aluminum alloys, the paint baking temperature is so low that no sufficient strength can be attained. Further, the formability lowers due to room temperature age hardening, and the corrosion resistance is poor.

In order to eliminate the above-described problems, Japanese Patent Application Laid-Open No. 64-65243 and U.S. Pat. No. 4,909,861 (Muraoka et al.) propose a process for manufacturing a material having an excellent bake hardenability. In this process, a heat treatment is further conducted within 72 hours after the solution heat treatment and cooling. However, reheating is necessary, and the bake hardenability in working examples is unsatisfactory for actually reducing the weight. In order to reduce the weight by 10% as compared with the conventional 5000 series alloys, a bake hardenability of about 50 MPa appears to be necessary although it depends upon the shape of the body.

Patent applications relevant to Japanese Patent Application Laid-Open No. 64-65243 have been filed by the same assignee (see Japanese Patent Application Laid-Open Nos. 62-89852, 62-177143, 1-111851, 2-205660 and 3-294456). Among them, Japanese Patent Application Laid-Open No. 1-111851 discloses that when the hardening is conducted by allowing the material to stand at room temperature below 60° C., the bake hardenability at a temperature as low as about 170° C. disappears with prolonging of the hardening time. Further, Japanese Patent Application Laid-Open No. 2-205660 discloses that the properties lower once the temperature is lowered to room temperature, and in the working example of this Patent Application, there is a description to the effect that the bake hardenability lowers when the material is allowed to stand for a long period of time. For this reason, in order to attain sufficient hardening, as described above, it is preferred to conduct a heat treatment within a time as short as possible, that is, one hour, after cooling.

In the manufacture of a body sheet material on a commercial scale, however, since a continuous annealing furnace is used in the solution heat treatment and cooling, the material is treated in the coil form. For this reason, it is difficult to transfer the material to the next step within one hour to conduct a heat treatment, so that there occurs a problem in an actual operation.

Japanese Patent Application Laid-Open No. 1-111851 discloses that the material after the solution heat treatment is cooled to 60 to 130° C. and held at that temperature. In the treatment of the material in the coil form on a commercial scale, it is very inefficient and difficult to hold the material at the above-described temperature for a long period of time (0.5 hour or longer).

The provision of the limitation of the time for transfer to the next step is unfavorable from the viewpoint of production on a commercial scale even when the time requirement is such that the material is transferred to the next step after the solution heat treatment and cooling without any additional treatment, or within 72 hours after hardening. The process which comprises conducting a similar solution heat treatment, allowing the treated material to stand at room temperature for a period of time as short as possible and heating and holding the material at 50 to 150° C. has a drawback that the step of reheating becomes necessary after the solution heat treatment.

SUMMARY OF THE INVENTION

Accordingly, an object of the present invention is to provide a process for manufacturing an aluminum alloy sheet material for forming with excellent shape fixability and bake hardenability through the regulation of a heat pattern in the step of cooling after the solution heat treatment.

The shape fixability during forming can be improved by bringing the yield strength of the material before forming to 140 MPa or less and conducting hardening through heating (175° C. for 30 minutes) at the time of paint baking after forming to enhance the yield strength and tensile strength. This contributes to an improvement also in the dentability of the formed article. In view of these facts, the present inventors have made intensive studies and, as a result, have found that an aluminum alloy sheet material having the above-described performance can be prepared by dividing the step of cooling after the solution heat treatment into two stages, which has led to the completion of the present invention.

The gist of the present invention resides in a process for manufacturing an aluminum alloy material for forming with excellent shape fixability and bake hardenability, the process comprising the steps of:

conducting semicontinuous casting of an aluminum alloy comprising 0.4 to 1.7% Si and 0.2 to 1.4% Mg, optionally further comprising 0.05% or less Ti and 100 ppm or less B, and optionally further comprising at least one member selected from the group consisting of 1.00% or less Cu, 0.50% or less Mn, 0.20% or less Cr and 0.20% or less V, with the balance consisting of Al and unavoidable impurities;

subjecting the cast alloy to conventional hot rolling;

conducting solution heat treatment by maintaining the hot-rolled alloy at a temperature of from 450 to 580° C. for 10 minutes or less, conducting first-stage cooling of the alloy at a cooling rate of 200° C./min or more to a quenched temperature in the range of from 60 to 250° C.; and conducting second-stage cooling of the alloy at a cooling rate selected from among those falling within the zone defined by the lines joining the points of A (200° C., 30° C./min), B (60° C., 0.3° C./min), C. (60° C., 0.01° C./min) and D (250° C., 30° C./min) shown in the attached FIG. 2 showing the relationship between the temperature range of the first-stage cooling and the cooling rate.

Percentages given in this application are by weight unless otherwise indicated.

DETAILED DESCRIPTION OF THE PREFERRED EMBODIMENTS

Figure 1:
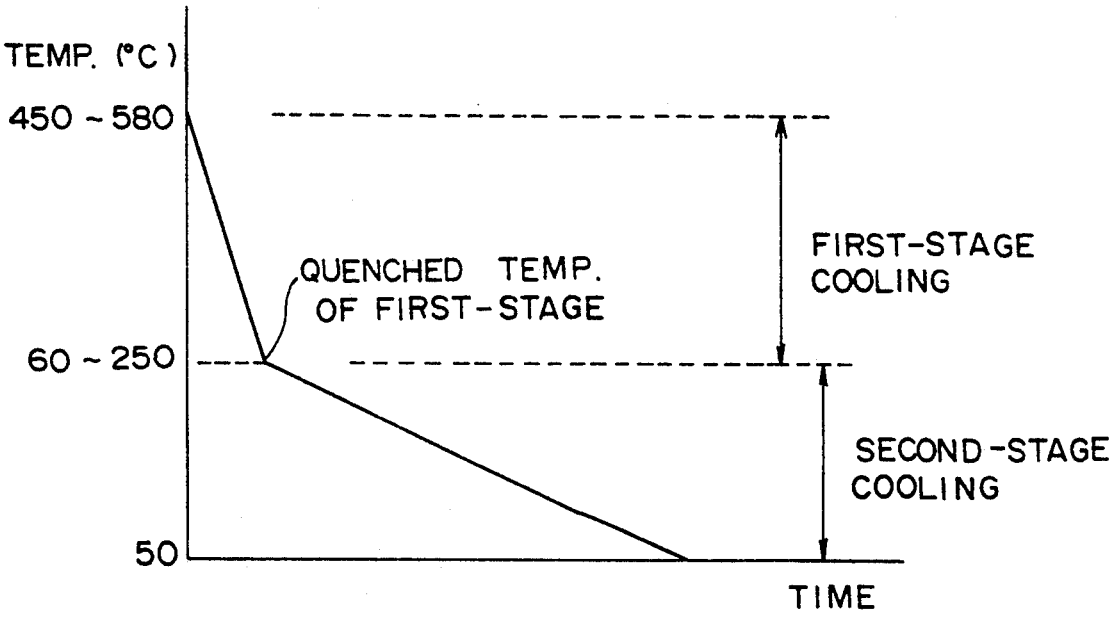
FIG. 1 shows a controlled heat pattern in the step of cooling after the solution heat treatment.

The reason for the limitation of the above-described constituent features will now be described.

Si: It is needed to obtain high strength and form $Mg_2Si$ so as to provide high strength. When the amount thereof is less than 0.4%, the strength is low and no satisfactory strength can be obtained even when heating in paint bake is conducted. On the other hand, when the amount exceeds 1.7%, the yield strength is too high after the solution heat treatment and the formability and the shape fixability are poor.

Mg: It is needed to obtain high strength like Si. When the amount of Mg is less than 0.2%, the strength is low and no satisfactory strength can be obtained even when heating in paint bake is conducted. On the other hand, when the amount exceeds 1.4%, the yield strength is too high after the solution heat treatment and the formability and the shape fixability are poor.

Cu: Its addition contributes to a further increase in the strength. However, when the amount of addition exceeds 1.00%, the yield strength is too high after the solution heat treatment and not only the formability and the shape fixability but also the corrosion resistance (filiform corrosion resistance) are poor.

Mn: Its addition contributes to a further increase in the strength and makes the grains finer so as to improve the formability. However, when the amount of addition exceeds 0.50%, the yield strength is too high after the solution heat treatment and not only the formability and the shape fixability are poor but also coarse intermetallic compounds are increased so as to lower the formability.

Cr: Its addition contributes to a further increase in the strength and makes the grains finer so as to improve the formability. However, when the amount of addition exceeds 0.20%, the yield strength is too high after the solution heat treatment and not only the formability and the shape fixability are poor but also coarse intermetallic compounds are increased so as to lower the formability.

V: Its addition contributes to a further increase in the strength. However, when the amount of addition exceeds 0.20%, the yield strength is too high after the solution heat treatment and the formability and the shape fixability are poor.

Ti: Its addition makes the cast structure finer so as to prevent the ingot from cracking. However, when the amount of addition exceeds 0.05%, coarse intermetallic compounds are increased so as to lower the formability.

B Its addition in combination with Ti makes the cast structure finer so as to prevent the ingot from cracking. However, when the amount of addition exceeds 100 ppm, coarse intermetallic compounds are increased so as to lower the formability.

CONDITIONS FOR SOLUTION HEAT TREATMENT

When the heating temperature is below 450° C., the solid dissolution of precipitates is unsatisfactory and no satisfactory strength can be attained after paint bake. When the heating temperature is higher than 580° C., the performance is saturated or eutectic melting occurs to thereby lower the formability. A holding time of longer than 10 minutes does not bring about any further improvement in the performance, so that it is less valuable from the industrial viewpoint.

FIRST-STAGE COOLING

In the cooling down to a temperature in the range of from 60 to 250° C., when the cooling rate is less than 200° C./min or the quenched temperature of the first stage is higher than 250° C., coarse intermetallic compounds are precipitated along the grain boundaries so as to lower the ductility, thus leading to poor formability. When the quenched temperature of the first stage is lower than 60° C., no satisfactory performance can be attained even when subsequent cooling rate is regulated.

RATE OF COOLING FROM THE QUENCHED TEMPERATURE OF THE FIRST STAGE (250 TO 60° C.) TO 50° C.

Specifying the rate of cooling from the quenched temperature of the first stage (250 t 60° C.) to 50° C. is the point of the present invention. Specifically, the formation of the GP zone can be suppressed when cooling after the solution heat treatment is changed in two stages during the cooling so that the cooling rate in the latter stage is lower than that in the former stage, as shown in a heat pattern of FIG. 1. This renders the Yield strength after the solution heat treatment low, contributes to an improvement in the formability and the shape fixability and enables the strength to be improved through heating in paint bake after the forming.

Figure 2:
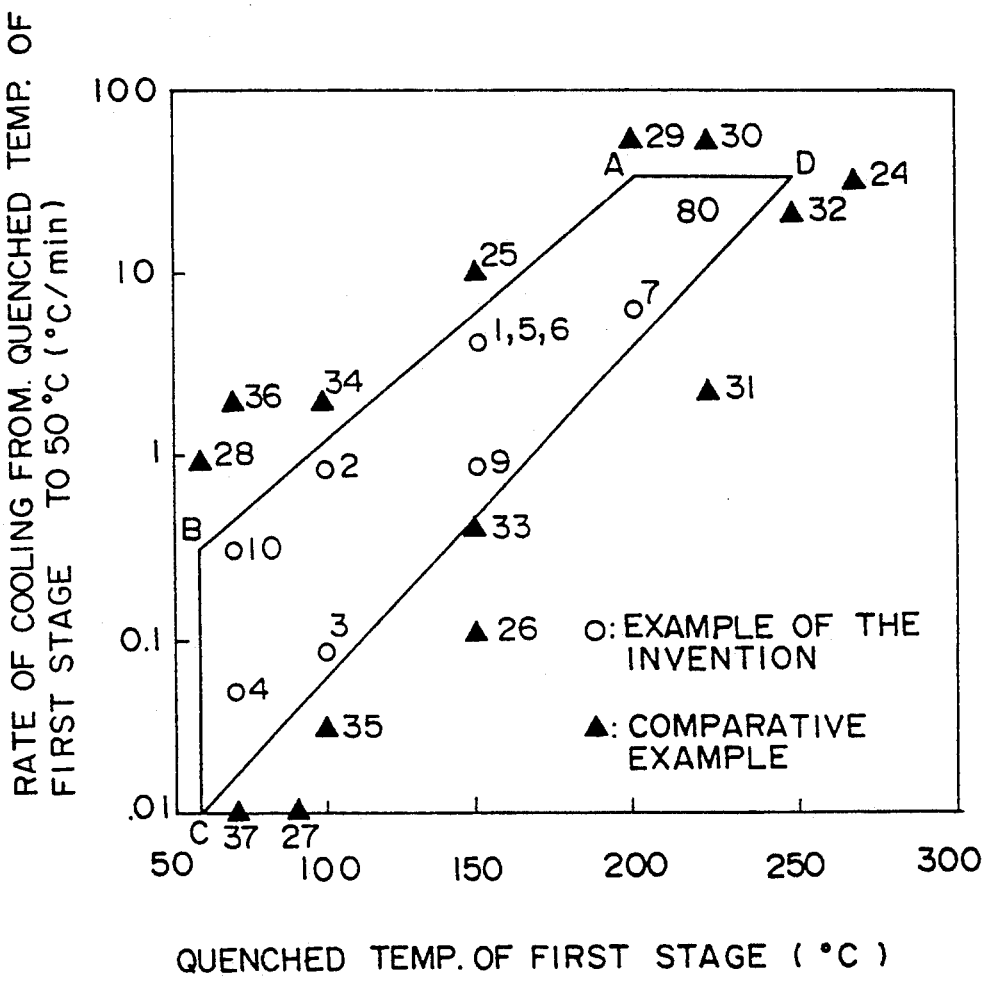
FIG. 2 is a graph showing the relationship between the cooling rate and the quenched temperature according to the present invention.

After the solution heat treatment, the material is firstly cooled at a cooling rate of 200° C./min or more to a quenched temperature of the first stage of 250° C. to 60° C. and, then, cooled at a cooling rate as shown in FIG. 2 depending upon the quenched temperature of the first stage. When the cooling is conducted at a cooling rate above this range, the prevention of formation of the GP zone is so unsatisfactory that the bake hardenability is poor. On the other hand, when the cooling is conducted at a cooling rate below the above range the Yield strength increases through the same action as that in the case of the artificial aging so that the formability lowers.

EXAMPLES

Each alloy listed in Table 1 was semicontinuously cast and the surface of the ingot was scalped. Subsequently, the alloy was homogenized at 550° C. for 24 hours, and the temperature was then allowed to fall to 520° C. Hot rolling was started at that temperature, and the alloy was rolled to a thickness of 5 mm. Then, the hot-rolled alloy was subjected to intermediate annealing at 360° C. for one hour in a batch furnace and cold-rolled to prepare a sheet having a thickness of 1 mm. The sheet was subjected to solution heat treatment under the conditions specified in Table 2, cooled to a quenched temperature of the first stage and then to 50° C. at varied cooling rates. The mechanical properties of the obtained materials were evaluated after aging at room temperature for one month subsequent to the cooling treatment.

TABLE 1

| | (wt. % except for B (ppm)) | | | | | | | | | |
|---|---|---|---|---|---|---|---|---|---|---|
| Alloy | Si | Mg | Cu | Mn | Cr | V | Ti | B (ppm) | Fe | Al |
| Ex. of present invention | | | | | | | | | | |
| A | 0.8 | 0.7 | — | — | — | — | — | — | 0.15 | bal. |
| B | 1.4 | 1.2 | — | — | — | — | 0.02 | 20 | 0.15 | bal. |
| C | 1.3 | 0.4 | — | — | — | — | 0.02 | 20 | 0.15 | bal. |
| D | 0.8 | 0.7 | 0.40 | — | — | — | — | — | 0.15 | bal. |
| E | 0.8 | 0.7 | — | 0.20 | — | — | — | — | 0.15 | bal. |
| F | 0.8 | 0.7 | — | — | 0.07 | — | 0.02 | 20 | 0.15 | bal. |
| G | 0.8 | 0.7 | — | — | — | 0.08 | 0.02 | 20 | 0.15 | bal. |
| H | 0.8 | 0.7 | 0.30 | 0.10 | — | — | 0.02 | 20 | 0.15 | bal. |
| I | 0.8 | 0.7 | 0.40 | — | 0.10 | — | 0.02 | 20 | 0.15 | bal. |
| J | 0.8 | 0.7 | 0.30 | — | — | 0.08 | 0.02 | 20 | 0.15 | bal. |
| K | 0.8 | 0.7 | — | 0.30 | 0.10 | — | 0.02 | 20 | 0.15 | bal. |
| L | 0.8 | 0.7 | 0.30 | 0.10 | — | 0.08 | 0.02 | 20 | 0.15 | bal. |
| Comp. Ex. | | | | | | | | | | |
| M | 0.3 | 0.7 | — | — | — | — | 0.02 | 20 | 0.15 | bal. |
| N | 0.8 | 0.1 | — | — | — | — | 0.02 | 20 | 0.15 | bal. |
| O | 2.0 | 0.7 | — | — | — | — | 0.02 | 20 | 0.15 | bal. |
| P | 0.8 | 2.0 | — | — | — | — | 0.02 | 20 | 0.15 | bal. |
| Q | 0.8 | 0.7 | 1.30 | — | — | — | 0.02 | 20 | 0.15 | bal. |
| R | 0.8 | 0.7 | — | 0.70 | — | — | 0.02 | 20 | 0.15 | bal. |

TABLE 1-continued

| Alloy | Si | Mg | Cu | Mn | Cr | V | Ti | B (ppm) | Fe | Al |
|---|---|---|---|---|---|---|---|---|---|---|
| | (wt. % except for B (ppm)) | | | | | | | | | |
| S | 0.8 | 0.7 | — | — | 0.30 | — | 0.02 | 20 | 0.15 | bal. |
| T | 0.8 | 0.7 | — | — | — | 0.30 | 0.02 | 20 | 0.15 | bal. |
| U | 0.8 | 0.7 | — | — | — | — | 0.09 | 20 | 0.15 | bal. |
| V | 0.8 | 0.7 | — | — | — | — | 0.02 | 200 | 0.15 | bal. |

Note) Fe: impurity

TABLE 2

| Classification | Heat treatment | Solution heat treatment temp. (°C.) | Solution heat treatment time (min) | First-stage cooling: Rate of cooling to the quenched temp. of the first-stage (°C./min) | First-stage cooling: Quenched temp. of the first-stage (°C.) | Second-stage cooling: Rate of cooling from the quenched temp. of the first stage to 50° C. (°C./min) |
|---|---|---|---|---|---|---|
| Ex. of present invention | i | 530 | 2 | 500 | 225 | 20 |
| | ii | " | " | " | 200 | " |
| | iii | " | " | " | " | 6 |
| | iv | " | " | " | 150 | 4 |
| | v | " | " | " | " | 0.8 |
| | vi | " | " | " | 100 | " |
| | vii | " | " | " | " | 0.08 |
| | viii | " | " | " | 70 | 0.3 |
| | ix | " | " | " | " | 0.05 |
| | x | " | " | 200 | 150 | 4 |
| | xi | 470 | 5 | 500 | " | " |
| Comp Ex. | xii | 530 | 2 | 500 | 270 | 30 |
| | xiii | " | " | " | 250 | 20 |
| | xiv | " | " | " | 225 | 50 |
| | xv | " | " | " | " | 2 |
| | xvi | " | " | " | 200 | 50 |
| | xvii | " | " | " | 150 | 10 |
| | xviii | " | " | " | " | 0.4 |
| | xix | " | " | " | " | 0.1 |
| | xx | " | " | " | 100 | 2 |
| | xxi | 530 | 2 | 500 | 100 | 0.03 |
| | xxii | " | " | " | 90 | 0.01 |
| | xxiii | " | " | " | 70 | 2 |
| | xxiv | " | " | " | " | 0.01 |
| | xxv | " | " | " | 60 | 1 |
| | xxvi | " | " | 40 | 150 | 4 |
| | xxvii | 400 | 10 | 500 | " | " |

The results of evaluation of samples are given in Table 3. Materials having a Yield strength of 135 MPa or less after the one-month room temperature aging were deemed as having an excellent shape fixability. Materials having an elongation of 28% or more and an Erichsen value of 9.5 mm or more were deemed as having an excellent formability Materials exhibiting a yield strength increase of 50 MPa or more after heat treatment at 175° C. for 30 minutes even subsequent to the one-month room temperature aging were deemed as having an excellent bake hardenability. Similarly, materials exhibiting a yield strength of 135 MPa or more were deemed as having excellent dentability. These materials were regarded acceptable as the materials of the present invention. Unacceptable values are marked with asterisk (*) in Table 3.

TABLE 3

| | Sample No. | Alloy | Heat treatment | Properties of material subjected to solution heat treatment and cooling (after one-month room temp. aging): $\sigma_{0.2}(\alpha)$ (MPa) | $\sigma_B$ (MPa) | $\delta$ (%) | Erichsen value (mm) | Yield strength after paint baking $\sigma_{0.2}(\beta)$ (MPa) | $(\beta - \alpha)$ (MPa) |
|---|---|---|---|---|---|---|---|---|---|
| Ex. of present invention | 1 | A | iv | 110 | 208 | 29 | 9.8 | 183 | 73 |
| | 2 | A | vi | 118 | 212 | 30 | 9.8 | 185 | 67 |
| | 3 | A | vii | 123 | 220 | 30 | 9.9 | 192 | 69 |
| | 4 | A | ix | 108 | 205 | 31 | 10.3 | 171 | 63 |
| | 5 | A | xi | 113 | 210 | 30 | 10.0 | 184 | 71 |
| | 6 | A | x | 114 | 208 | 29 | 9.9 | 180 | 66 |
| | 7 | A | iii | 118 | 212 | 30 | 9.9 | 174 | 56 |
| | 8 | A | i | 122 | 214 | 29 | 9.7 | 181 | 59 |
| | 9 | A | v | 115 | 211 | 29 | 9.8 | 186 | 71 |
| | 10 | A | viii | 106 | 201 | 30 | 10.2 | 161 | 55 |
| | 11 | B | iv | 132 | 254 | 31 | 9.9 | 205 | 73 |
| | 12 | C | iv | 118 | 224 | 30 | 10.2 | 180 | 62 |
| | 13 | D | iv | 124 | 248 | 28 | 9.7 | 201 | 77 |
| | 14 | E | iv | 123 | 240 | 28 | 9.7 | 198 | 75 |
| | 15 | F | iv | 118 | 227 | 29 | 9.6 | 185 | 67 |
| | 16 | G | iv | 119 | 225 | 29 | 9.8 | 189 | 70 |
| | 17 | H | iv | 122 | 232 | 29 | 9.7 | 193 | 71 |
| | 18 | I | iv | 121 | 237 | 30 | 9.7 | 195 | 74 |

TABLE 3-continued

| | Sample No. | Alloy | Heat treatment | Properties of material subjected to solution heat treatment and cooling (after one-month room temp. aging) $\sigma_{0.2}(\alpha)$ (MPa) | $\sigma_B$ (MPa) | $\delta$ (%) | Erichsen value (mm) | Yield strength after paint baking $\sigma_{0.2}(\beta)$ (MPa) | $(\beta - \alpha)$ (MPa) |
|---|---|---|---|---|---|---|---|---|---|
| | 19 | J | iv | 124 | 236 | 29 | 9.8 | 196 | 72 |
| | 20 | K | iv | 130 | 240 | 29 | 9.8 | 199 | 69 |
| | 21 | L | iv | 133 | 256 | 28 | 9.7 | 206 | 73 |
| Comp. | 22 | A | xxvii | 82 | 154 | 26* | 9.0* | 83* | 1* |
| Ex. | 23 | A | xxvi | 101 | 178 | 25* | 8.8* | 103* | 2* |
| | 24 | A | xii | 145* | 257 | 26* | 9.1* | 208 | 63 |
| | 25 | A | xvii | 112 | 205 | 30 | 9.8 | 125* | 3* |
| | 26 | A | xix | 152* | 260 | 26* | 9.0* | 214 | 62 |
| | 27 | A | xxii | 140* | 251 | 28 | 9.8 | 194 | 54 |
| | 28 | A | xxv | 108 | 204 | 29 | 9.8 | 119* | 11* |
| | 29 | A | xvi | 109 | 206 | 30 | 9.9 | 139 | 30* |
| | 30 | A | xiv | 110 | 207 | 30 | 9.8 | 147 | 37* |
| | 31 | A | xv | 162* | 261 | 22* | 8.2* | 191 | 29* |
| | 32 | A | xiii | 148* | 239 | 26* | 9.3* | 181 | 33* |
| | 33 | A | xviii | 122 | 217 | 30 | 9.8 | 170 | 48* |
| | 34 | A | xx | 109 | 201 | 31 | 10.2 | 148 | 39* |
| | 35 | A | xxi | 123 | 219 | 29 | 9.7 | 169 | 46* |
| | 36 | A | xxiii | 107 | 203 | 30 | 9.9 | 114 | 7* |
| | 37 | A | xxiv | 138* | 230 | 28 | 9.8 | 184 | 46* |
| | 38 | M | iv | 105 | 193 | 28 | 9.5 | 122* | 17* |
| | 39 | N | iv | 102 | 189 | 29 | 9.7 | 118* | 16* |
| | 40 | O | iv | 164* | 289 | 30 | 9.8 | 221 | 57 |
| | 41 | P | iv | 172* | 291 | 29 | 9.5 | 229 | 57 |
| | 42 | Q | iv | 142* | 281 | 25* | 9.2* | 202 | 60 |
| | 43 | R | iv | 138* | 257 | 26* | 9.3* | 194 | 56 |
| | 44 | S | iv | 139* | 255 | 26* | 9.1* | 192 | 53 |
| | 45 | T | iv | 140* | 259 | 27* | 9.4* | 191 | 51 |
| | 46 | U | iv | 132 | 241 | 26* | 9.2* | 184 | 52 |
| | 47 | V | iv | 133 | 238 | 25* | 9.1* | 180 | 47* |

Note) The following properties are acceptable in the present invention.
Shape fixability: Yield strength, $\sigma_{0.2}(\alpha)$, of material subjected to solution heat treatment and cooling: 135 MPa or less
Formability: Elongation, $\delta$, of material subjected to solution heat treatment and cooling: 28% or more Erichsen value of material subjected to solution heat treatment and cooling: 9.5 mm or more
Bake hardenability: Yield strength, $\sigma_{0.2}(\beta)$, after paint baking: 135 MPa or more Increase in yield strength, $(\beta - \alpha)$, after paint baking: 50 MPa or more In each of the samples Nos. 1 to 21 which are examples of the present invention, the materials subjected to solution heat treatment and cooling had a yield strength of 106 to 132 MPa, that is, an excellent shape fixability, an elongation of 28 to 31% and an Erichsen value of 9.6 to 10.3 mm, that is, an excellent formability, and a yield strength of 161 to 205 MPa and an increase in the yield strength $(\beta-\alpha)$ of 55 to 77 MPa after paint baking, that is, an excellent bake hardenability.

On the other hand, in sample No. 22 which is a comparative example, since the solution heat treatment temperature is as low as 400° C., the material subjected to solution heat treatment and cooling had an elongation of 26% and an Erichsen value of 9.0 mm, that is, a poor formability. The yield strength and the increase in the yield strength $(\beta-\alpha)$ after paint baking were as low as 83 MPa and 1 MPa, respectively, so that not bake hardenability could be attained.

In sample No. 23, since the cooling rate to the quenched temperature of the first stage was as low as 40° C./min, the material had an elongation of 25% and an Erichsen value of 8.8 mm, that is, a poor formability. Further, the yield strength and the increase in the yield strength $(\beta-\alpha)$ after paint baking were as low as 103 MPa and 2 MPa, respectively, so that no bake hardenability could be attained.

In sample No. 24, since the quenched temperature of the first stage was as high as 270° C., the material subjected to solution heat treatment and cooling had a high yield strength of 145 MPa, that is, a poor shape fixability, and an elongation of 26% and an Erichsen value of 9.1 mm, that is, a poor formability.

In sample No. 25, since the rate of cooling after reaching the quenched temperature of the first stage was 10° C./min and too high as the rate for cooling from the quenched temperature (150° C.) of the first stage, as shown in FIG. 2, the yield strength and the increase in the yield strength $(\beta-\alpha)$ after paint baking were as low as 125 MPa and 3 MPa, respectively, so that no bake hardenability could be attained.

In sample No. 26, since the rate of cooling after reaching the quenched temperature of the first stage was 0.1° C./min and too low as the rate for cooling from the quenched temperature (150° C.) of the first stage, the material subjected to solution heat treatment and cooling had a yield strength after paint baking as high as 152 MPa, that is, a poor shape fixability, and an elongation of 26% and an Erichsen value of 9.0 mm, that is, a poor formability.

In sample No. 27, since the rate of cooling after reaching the quenched temperature of the first stage was 0.01° C./min and too low as the rate for cooling from the quenched temperature (90° C.) of the first stage, the material subjected to solution heat treatment and cooling had a Yield strength after paint baking as high as 140 MPa, that is, a poor shape fixability.

In sample No. 28, since the rate of cooling after reaching the quenched temperature of the first stage was 1° C./min and too high as the rate for cooling from the quenched temperature (60° C.) of the first stage, the yield strength and the increase in the yield strength $(\beta-\alpha)$ after paint baking were 119 MPa and 11 MPa, respectively, so that no bake hardenability could be attained.

In sample No. 29, since the rate of cooling after reaching the quenched temperature of the first stage was 50° C./min and too high as the rate for cooling from the quenched temperature (200° C.) of the first stage, the increase in the yield strength ($\beta-\alpha$) after paint baking was as low as 30 MPa, so that no bake hardenability could be attained.

In sample No. 30, since the rate of cooling after reaching the quenched temperature of the first stage was 50° C./min and too high as the rate for cooling from the quenched temperature (225° C.) of the first stage, the increase in the yield strength ($\beta-\alpha$) after paint baking was as low as 37 MPa, so that no bake hardenability could be attained.

In sample No. 31, since the rate of cooling after reaching the quenched temperature of the first stage was 2° C./min and too low as the rate for cooling from the quenched temperature (225° C.) of the first stage, the material subjected to solution heat treatment and cooling had a Yield strength as high as 162 MPa, that is, a poor shape fixability, and an elongation of 22% and an Erichsen value of 8.2 mm, that is, a poor formability. Further, the increase in the Yield strength ($\beta-\alpha$) after paint baking was as low as 29 MPa, so that no bake hardenability could be attained.

In sample No. 32, since the rate of cooling after reaching the quenched temperature of the first stage was 20° C./min and too low as the rate for cooling from the quenched temperature (150° C.) of the first stage, the material subjected to solution heat treatment and cooling had a yield strength as high as 148 MPa, that is, a poor shape fixability, and an elongation of 26% and an Erichsen value of 9.3 mm, that is, a poor formability. Further, the increase in the yield strength ($\beta-\alpha$) after paint baking was as low as 33 MPa, so that no bake hardenbility could be attained.

In sample No. 33, since the rate of cooling after reaching the quenched temperature of the first stage was 0.4° C./min and too low as the rate for cooling from the quenched temperature (150° C.) of the first stage, the increase in the yield strength ($\beta-\alpha$) after paint baking was as low as 48 MPa, so that no bake hardenability could be attained.

In sample No. 34, since the rate of cooling after reaching the quenched temperature of the first stage was 2° C./min and too high as the rate for cooling from the quenched temperature (100° C.) of the first stage, the increase in the Yield strength ($\beta-\alpha$) after paint baking was as low as 39 MPa, so that no bake hardenability could be attained.

In sample No. 35, since the rate of cooling after reaching the quenched temperature of the first stage was 0.03° C./min and too low as the rate for cooling from the quenched temperature (100° C.) of the first stage, the increase in the yield strength ($\beta-\alpha$) after paint baking was as low as 46 MPa, so that no bake hardenability could be attained.

In sample No. 36, since the rate of cooling after reaching the quenched temperature of the first stage was 2° C./min and too high as the rate for cooling from the quenched temperature (70° C.) of the first stage, the yield strength and the increase in the yield strength ($\beta-\alpha$) after paint baking were as low as 114 MPa and 7 MPa, respectively, so that no bake hardenability could be attained.

In sample No. 37, since the rate of cooling after reaching the quenched temperature of the first stage was 0.01° C./min and too low as the rate for cooling from the quenched temperature (70° C.) of the first stage, the material subjected to solution heat treatment and cooling had a yield strength as high as 138 MPa, that is, a poor shape fixability. Further, the increase in the yield strength ($\beta-\alpha$) after paint baking was 46 MPa, so that no bake hardenability was attained.

FIG. 2 is a graph showing the relationship between the quenched temperature of the first stage and the rate of cooling after reaching the quenched temperature of the first stage determined from the above-described results. Samples Nos. 1 to 10 which are examples of the present invention represented by "o", and samples Nos. 22 to 37 which are comparative examples are represented by "▲" to determine the zone ABCD of the present invention.

In samples Nos. 38 to 47, although the heat treatment conditions were set so as to fall within the scope of the present invention, the alloying components are outside the scope of the present invention.

In sample No. 38, since the Si content was as low as 0.3%, the yield strength and the increase in the yield strength ($\beta-\alpha$) after paint baking were 122 MPa and 17 MPa, respectively, so that no bake hardenability could be attained.

In sample No. 39, since the Mg content was as low as 0.1%, the yield strength and the increase in the yield strength ($\beta-\alpha$) after paint baking were 118 MPa and 16 MPa, respectively, so that no bake hardenability could be attained.

In sample No. 40, since the Si content was as high as 2.0%, the material subjected to solution heat treatment and cooling had a high yield strength of 164 MPa, that is, a poor shape fixability.

In sample No. 41, since the Mg content was as high as 2.0%, the materials subjected to solution heat treatment and cooling had a yield strength as high as 172 MPa, that is, a poor shape fixability.

In sample No. 42, since the Cu content was as high as 1.30%, the material subjected to solution heat treatment and cooling had a yield strength as high as 142 MPa, that is, a poor shape fixability, and an elongation of 25% and an Erichsen value of 9.2 mm, that is, a poor formability.

In sample No. 43, since the Mn content was as high as 0.70%, the material subjected to solution heat treatment and cooling had a yield strength as high as 138 MPa, that is, a poor shape fixability, and an elongation of 26% and an Erichsen value of 9.3 mm, that is, a poor formability.

In sample No. 44, since the Cr content was as high as 0.30%, the material subjected to solution heat treatment and cooling had a Yield strength as high as 139 MPa, that is, a poor shape fixability, and an elongation of 26% and an Erichsen value of 9.1 mm, that is, a poor formability.

In sample No. 45, since the V content was as high as 0.30%, the material subjected to solution heat treatment and cooling had a high Yield strength of 140 MPa, that is, a poor shape fixability, and an elongation of 27% and an Erichsen value of 9.4 mm, that is, a poor formability.

In sample No. 46, since the Ti content was as high as 0.09%, the material subjected to solution heat treatment and cooling had an elongation of 26% and an Erichsen value of 9.2 mm, that is, a poor formability.

In sample No. 47, since the B content was as high as 200 ppm the material subjected to solution heat treatment and cooling had an elongation of 25% and an Erichsen value of 9.1 mm, that is, a poor formability.

According to the present invention, an aluminum alloy material is subjected to a controlled heat pattern as shown in FIG. 1 (the step of cooling after the solution heat treatment is divided into two stages in such a manner that the cooling rate in the latter stage is smaller than that of the former stage for the purpose of suppressing the formation of GP zone) in the step of cooling after the solution heat treatment to lower the yield strength after the solution heat treatment, improve the formability and shape fixability and improve the strength through heating in paint baking after forming. In other words, the material according to the present invention exhibits an excellent formability during forming, and the strength can be enhanced by conducting paint baking after the forming. This makes it possible to prepare an aluminum alloy sheet material formed into panels of automobiles, which renders the present invention useful from the viewpoint of industry.

What is claimed is:

1. A process for manufacturing an aluminum alloy material for forming having excellent shape fixability and bake hardenability, the process comprising the steps of:

conducting semicontinuous casting of an aluminum alloy comprising 0.4 to 1.7% by weight Si and 0.2 to 1.4% by weight Mg, with the balance consisting of Al and unavoidable impurities;

subjecting the cast alloy to conventional hot rolling;

conducting solution heat treatment by maintaining the hot-rolled alloy at a temperature of from 450 to 580° C. for 10 minutes or less;

conducting first-stage cooling of the alloy at a cooling rate of 200° C./min or more to a quenched temperature in the range of from 60 to 250° C.; and, depending upon the quenched temperature of the first stage cooling, conducting second-stage cooling of the alloy at a cooling rate selected from among those falling within the zone defined by the lines joining the points of A (200° C., 30° C./min.), B (60° C., 0.3° C./min.), C (60° C., 0.01° C./min) and D (250° C., 30° C./min), shown in FIG. 2 showing the relationship between the temperature range of the first-stage cooling and the cooling rate, to a final temperature of 50° C.

2. A process for manufacturing an aluminum alloy material for forming having excellent shape fixability and the bake hardenability, the process comprising the steps of:

conducting semicontinuous casting of an aluminum alloy comprising 0.4 to 1.7 wt.% Si and 0.2 to 1.4 wt.% Mg and further comprising 0.05 wt.% or less Ti and 100 ppm or less B, with the balance consisting of Al and unavoidable impurities;

subjecting the cast alloy to conventional hot rolling;

conducting solution heat treatment by maintaining the hot-rolled alloy at a temperature of from 450 to 580° C. for 10 minutes or less;

conducting first-stage cooling of the alloy at a cooling rate of 200° C./min or more to a quenched temperature in the range of from 60 to 250° C.; and, depending upon the quenched temperature of the first stage cooling, conducting second-stage cooling of the alloy at a cooling rate selected from among those falling within the zone defined by the lines joining the points of A (200° C., 30° C./min), B (60° C., 0.3° C./min), C (60° C., 0.01° C./min) and D (250° C., 30° C./min), shown in FIG. 2 showing the relationship between the temperature range of the first-stage cooling and the cooling rate, to a final temperature of 50° C.

3. A process for manufacturing an aluminum alloy material for forming having excellent shape fixability and bake hardenability, the process comprising the steps of:

conducting semicontinuous casting of an aluminum alloy comprising 0.4 to 1.7 wt.% Si and 0.2 to 1.4 wt.% Mg and further comprising at least one member selected from the group consisting of 1.00 wt.% or less Cu, 0.50 wt.% or less Mn. 0.20 wt.% or less Cr and 0.20 wt.% or less V, 0.05 wt.% or less Ti and 100 ppm or less B, with the balance consisting of Al and unavoidable impurities;

subjecting the cast alloy to conventional hot rolling;

conducting solution heat treatment by maintaining the hot-rolled alloy at a temperature of from 450 to 580° c. for 10 minutes or less;

conducting first-stage cooling of the alloy at a cooling rate of 200° C./min or more to a quenched temperature in the range of from 60 to 250° C.; and, depending upon the quenched temperature of the first stage cooling, conducting second-stage cooling of the alloy at a cooling rate selected from among those falling within the zone defined by the lines joining the points of A (200° C., 30° C./min), B (60° C., 0.3° C./min), C (60° C., 0.01° C./min) and D (250° C., 30° C./min), shown in FIG. 2 showing the relationship between the temperature range of the first-stage cooling and the cooling rate, to a final temperature of 50° C.

* * * * *

UNITED STATES PATENT AND TRADEMARK OFFICE

CERTIFICATE OF CORRECTION

PATENT NO. : 5 266 130

DATED : November 30, 1993

INVENTOR(S) : Hidetoshi Uchida et al

It is certified that error appears in the above-identified patent and that said Letters Patent is hereby corrected as shown below:

Column 14, line 29; after "Mn" change the period (.) to a comma ---,---.

Signed and Sealed this

Thirty-first Day of May, 1994

*Attest:*

BRUCE LEHMAN

*Attesting Officer*

*Commissioner of Patents and Trademarks*